US010702729B2

(12) United States Patent
Browning, Jr.

(10) Patent No.: US 10,702,729 B2
(45) Date of Patent: Jul. 7, 2020

(54) MULTI-LEVEL PLAY EQUIPMENT

(71) Applicant: Michael Browning, Jr., Grapevine, TX (US)

(72) Inventor: Michael Browning, Jr., Grapevine, TX (US)

(73) Assignee: UATP IP, LLC, Grapevine, TX (US)

( * ) Notice: Subject to any disclaimer, the term of this patent is extended or adjusted under 35 U.S.C. 154(b) by 49 days.

(21) Appl. No.: 15/926,303

(22) Filed: Mar. 20, 2018

(65) Prior Publication Data

US 2018/0272172 A1 Sep. 27, 2018

Related U.S. Application Data

(60) Provisional application No. 62/474,220, filed on Mar. 21, 2017.

(51) Int. Cl.

| | |
|---|---|
| ***A63B 9/00*** | (2006.01) |
| ***A63G 31/02*** | (2006.01) |
| ***A63G 31/10*** | (2006.01) |
| ***A63G 21/00*** | (2006.01) |
| ***A63G 21/22*** | (2006.01) |
| ***A63G 31/00*** | (2006.01) |
| ***A63B 69/00*** | (2006.01) |
| ***A63B 7/00*** | (2006.01) |
| ***A63G 21/20*** | (2006.01) |
| ***A63G 33/00*** | (2006.01) |
| ***A63G 9/00*** | (2006.01) |

(52) U.S. Cl.

CPC ..... *A63B 9/00* (2013.01); *A63G 9/00* (2013.01); *A63G 21/00* (2013.01); *A63G 21/20* (2013.01); *A63G 21/22* (2013.01); *A63G 31/00* (2013.01); *A63G 31/02* (2013.01); *A63G 31/10* (2013.01); *A63G 33/00* (2013.01); *A63B 7/00* (2013.01); *A63B 69/0064* (2013.01); *A63B 2009/002* (2013.01); *A63B 2009/004* (2013.01); *A63B 2009/006* (2013.01); *A63B 2208/12* (2013.01)

(58) Field of Classification Search

CPC ..... A63B 9/00; A63B 7/00; A63B 69/0064; A63B 2208/12; A63B 2009/002; A63B 2009/004; A63B 2009/006; A63G 9/00; A63G 21/00; A63G 21/20; A63G 21/22; A63G 31/00; A63G 31/10; A63G 33/00; A63G 31/02

USPC ..... 472/128

See application file for complete search history.

(56) References Cited

U.S. PATENT DOCUMENTS

| | | | |
|---|---|---|---|
| 3,814,416 | A | 6/1974 | Munger et al. |
| 4,337,941 | A | 7/1982 | Kitka |
| 5,203,829 | A | 4/1993 | Fisk et al. |
| 5,226,864 | A | 7/1993 | Showers |

(Continued)

*Primary Examiner* — Andrew S Lo

(74) *Attorney, Agent, or Firm* — Decker Jones PC; Brian K. Yost; Geoffrey A. Mantooth

(57) ABSTRACT

A play apparatus has plural types of elevated equipment, namely a ropes course and a zip coaster. Both types of elevated equipment have respective user safety supports that extend along the respective equipment and receive a safety harness worn by a user. The user need not change safety harnesses to use the different types of equipment. The entry and exit locations for the elevated equipment are in a common area elevated above the ground. A third type of equipment, namely an obstacle course, is located under and above the common area.

12 Claims, 13 Drawing Sheets

(56) References Cited

U.S. PATENT DOCUMENTS 5,853,332 A 12/1998 Briggs
6,108,988 A 8/2000 Nagelski et al.
6,174,242 B1 1/2001 Briggs et al.
6,193,633 B1 2/2001 Jonas et al.
7,631,728 B2 12/2009 Hill et al.
8,066,578 B2 11/2011 Liggett
2004/0077423 A1* 4/2004 Weston ..... A63G 31/00 472/137
2006/0090960 A1* 5/2006 Liggett ..... A62B 35/0056 182/36
2006/0189453 A1* 8/2006 Leblond ..... A62B 35/0087 482/69
2007/0191123 A1* 8/2007 Liggett ..... A63G 31/02 472/15
2009/0065300 A1* 3/2009 Liggett ..... A63B 17/00 182/36
2009/0069104 A1* 3/2009 Liggett ..... A63G 31/00 472/136
2009/0305799 A1* 12/2009 Weston ..... A63G 3/00 472/128
2010/0203494 A1* 8/2010 Scherba ..... A63G 9/00 434/365
2011/0083577 A1* 4/2011 Tilley ..... B61B 7/06 104/96
2012/0010009 A1* 1/2012 Sperry ..... A63B 17/00 472/92
2012/0083350 A1* 4/2012 Frankowski ..... A63G 31/00 472/128
2013/0130867 A1* 5/2013 Sperry ..... A63B 17/00 482/8
2015/0090148 A1* 4/2015 Weston ..... A63G 21/20 104/91
2015/0141205 A1* 5/2015 Garland ..... A63B 4/00 482/35
2015/0217783 A1 8/2015 Horihan
2016/0074687 A1* 3/2016 Sann ..... A63B 17/02 482/35
2017/0043268 A1* 2/2017 Briggs ..... A63G 31/02
2017/0157433 A1* 6/2017 Cylvick ..... A62B 1/20
2017/0173378 A1* 6/2017 Garland ..... A63B 9/00
2017/0197638 A1* 7/2017 Perry ..... B61B 7/00
2017/0327129 A1* 11/2017 Cylvick ..... B61B 12/002
2018/0326957 A1* 11/2018 McGowan ..... A63G 21/22
2018/0369700 A1* 12/2018 Cylvick ..... B61L 23/14

* cited by examiner

MULTI-LEVEL PLAY EQUIPMENT

FIELD OF THE INVENTION

The present invention refutes to play equipment that people can walk on, run on, climb on, ride on and otherwise enjoy.

BACKGROUND OF THE INVENTION

Play equipment has evolved over the years. Early play equipment included a swing set and slide located outside in a residential yard or park. Over time, additions were made in the form of monkey bars, climbing apparatuses, elevated walkways, platforms, etc. Monkey bars are parallel bars or beams with cross-bars spaced like ladder rungs. Using the hands, a user hangs from the cross-bars and moves from one cross-bar to another. If a user should lose their grip, the user falls, typically feet first, onto the ground below. The ground may be pea gravel, which softens the landing. Platforms and elevated walkways are typically climbing equipment and are reached by climbing ladders. A user descends therefrom by slides, ladders or vertical poles.

Another type of play equipment includes ropes courses. While swing sets and associated climbing equipment typically take a relatively small area of ground, a ropes course takes up a much larger area and is elevated. A user ascends a pole to a platform, and walks or climbs across on ropes, boards, etc. Users wear a safety harness and are connected to a safety line or cable. The user is elevated sufficiently far above ground that if the user fell without safety equipment, injury could result.

Still another type of play equipment is a zip line. A zip line spans a long distance from one location to another and is elevated far above ground. The user is connected to a trolley or pulley and descends along the inclined zip line by way of gravity.

While outdoor play equipment continues in use, in many locales, play equipment can be found inside, in a temperature-controlled environment. Such indoor facilities offer the advantage of allowing play, regardless of the weather outside. In some locales, the weather can be warm or hot; the indoor facility is cooled with air conditioning. In other locales, the weather can be cold; the indoor facility is warmed. Indoor facilities also provide lighting to allow play activities to occur past sunset.

Indoor facilities include a variety of activities, such as trampolines and bounce houses (having inflated walls and floors). Padding is provided where needed. For example, with trampolines, padding is provided along the sides of the trampoline. The padding is typically foam covered in a plastic outer layer. In addition to the play equipment, some indoor facilities also include food sales and areas with tables to dine at.

Some indoor facilities are located in former industrial, retail, office, or flex buildings, with high roofs and ceilings, or with the floors cut through to create high ceilings. There is a desire to install elevated play equipment in these high roofed buildings, in order to increase the enjoyment for users. One such elevated type of equipment is a ropes course. Some ropes courses, particularly those for small children, may be a short distance above the floor, which floor is padding. If a child should fall, the child lands on soft padding. Many ropes courses however are elevated some distance above the floor, high enough to walk under. These ropes courses require the user to wear a safety harness.

Should a user fall, the fall is arrested by the safety harness and the user is slopped short well above ground.

Another elevated type of equipment is a zip coaster, or roll glider. A zip coaster is a rail that drops gradually in elevation from beginning to end. A user wears a harness and, suspended underneath, rides the rail on a type of trolley. The trolley moves in a gradual descent with low friction on the rail, pulled by the weight of the user. Zip coaster rails are typically curved, thus allowing the user to swing to the outside of the curve, further adding to the enjoyment of the ride.

In the prior art, there are several multi-level types of play equipment. Showers U.S. Pat. No. 5,226,864 shows a playground maze apparatus having four levels. Users can move from one level to another by climbing through apertures in the floors or ceilings of a level. Once on a particular level, the user can move around rooms and maze configurations.

Nagelski U.S. Pat. No. 6,108,988 shows a tower with a spiral staircase. Openings are provided on an outer wall to allow children to climb through.

Jonas U.S. Pat. No. 6,193,633 shows a climbing wall extending to an upper level, which upper level is also accessible by a ladder.

Munger U.S. Pat. No. 3,814,416 shows ladders and horizontal bars arranged in vertical and inclined positions to create climbing structures.

Kitka U.S. Pat. No. 4,337,941 shows a climbing structure with ladders, horizontal half logs and vertical poles, as well as a slide.

Briggs U.S. Pat. Nos. 5,853,332 and 6,174,242 show multi-level play structures having devices that shoot soft projectiles.

It is desired to improve play structures, and in particular to provide play structures with different types of elevated equipment to enhance the enjoyment by users.

SUMMARY OF THE INVENTION

A play apparatus comprises a first type of elevated equipment. The first elevated equipment has a first user safety support that extends for a first traverse. The first user safety support is elevated above the ground level. The first user safety support receives a safety harness worn by a user and allows the safety harness to move with the user along the first traverse. The first elevated equipment has a first entry location for the user to enter the first elevated equipment and a first exit location for the user to exit the first elevated equipment. A second type of elevated equipment has a second user safety support that extends for a second traverse distance. The second user safety support is elevated above the ground level. The second user safety support receives the safety harness worn by the user. The second user safety support allows the safety harness to move with the user along the second traverse. The second elevated equipment has a second entry location for the user to enter the second elevated equipment and a second exit location for the user to exit the second elevated equipment. A common area is elevated above the ground. The common area includes the first entry location, the first exit location, the second entry location and the second exit location.

In accordance with one aspect, the first type of elevated equipment is different than the second type of elevated equipment.

In accordance with another aspect, the first type of elevated equipment comprises a ropes course.

In accordance with another aspect, the second type of elevated equipment comprises a zip coaster.

In accordance with another aspect, the zip coaster further comprises a rail, further comprising a control device located on the rail and moveable between blocking and open positions, wherein when the control device is in the blocking position, forward movement of a trolley on the rail past the control device is stopped and when the control device is in the open position, forward movement of the trolley past the control device is allowed.

In accordance with another aspect, the first entry location and the first exit location are one location.

In accordance with another aspect, a loading area is provided. The loading area comprises am entry gate that allows entry to the second entry location and an exit gate that allows exiting from the second exit location.

In accordance with another aspect, a third type of equipment is located under the common area.

In accordance with another aspect, the third type of equipment comprises an obstacle course.

In accordance with another aspect, the third type of equipment has portions located above the common area.

In accordance with another aspect, the first type of elevated equipment comprises a ropes course. The second type of equipment comprises a zip coaster. A loading area is provided, which loading area comprising an entry gate that allows entry to the second entry location and an exit gate that allows exiting from the second exit location. A third type of equipment is located under the common area.

DESCRIPTION OF THE PREFERRED EMBODIMENTS

The present invention combines several different types of equipment, ranging from ground level, to above the ground, and elevated, all of which make for an efficient use of space and which is enjoyable to use. Such elevated equipment is located a sufficient distance above the ground or other structure such that a user wears a safety harness or other safety device in case the user should fall. An example of another type of equipment is climbing equipment. Such climbing equipment includes multiple levels that users access by stairs, ladders, slides, etc. The levels are typically stacked vertically.

In the preferred embodiment, one type of elevated equipment is a ropes course. A user traversing the ropes course is located at a first elevation above ground. The load bearing surfaces or structures for the user are located at the first elevation.

Another type of elevated equipment is a zip coaster. The zip coaster has a rail that begins at a second elevation and ends at a lower elevation; gravity pulls the user along the rail from beginning to end. The second elevation is different from the first elevation. For example, the second elevation can be higher than the first elevation.

The several types of elevated equipment utilize a common elevated area for entry onto and egress from the respective pieces of equipment. The several types of elevated equipment require users to wear safely harnesses or other safety equipment in case the users should fall. In many cases, the elevated equipment may be located eight feet or more above the ground or floor. Such heights are sufficiently high so that is a user should fall from the elevated equipment and land on the ground or floor, injury may result, even if the floor is padded.

The space underneath the common elevated area contains a third type of equipment. This space is typically on ground level.

Although the preferred embodiment describes an indoor environment, the equipment can be used in an outdoor environment.

Figure 3:
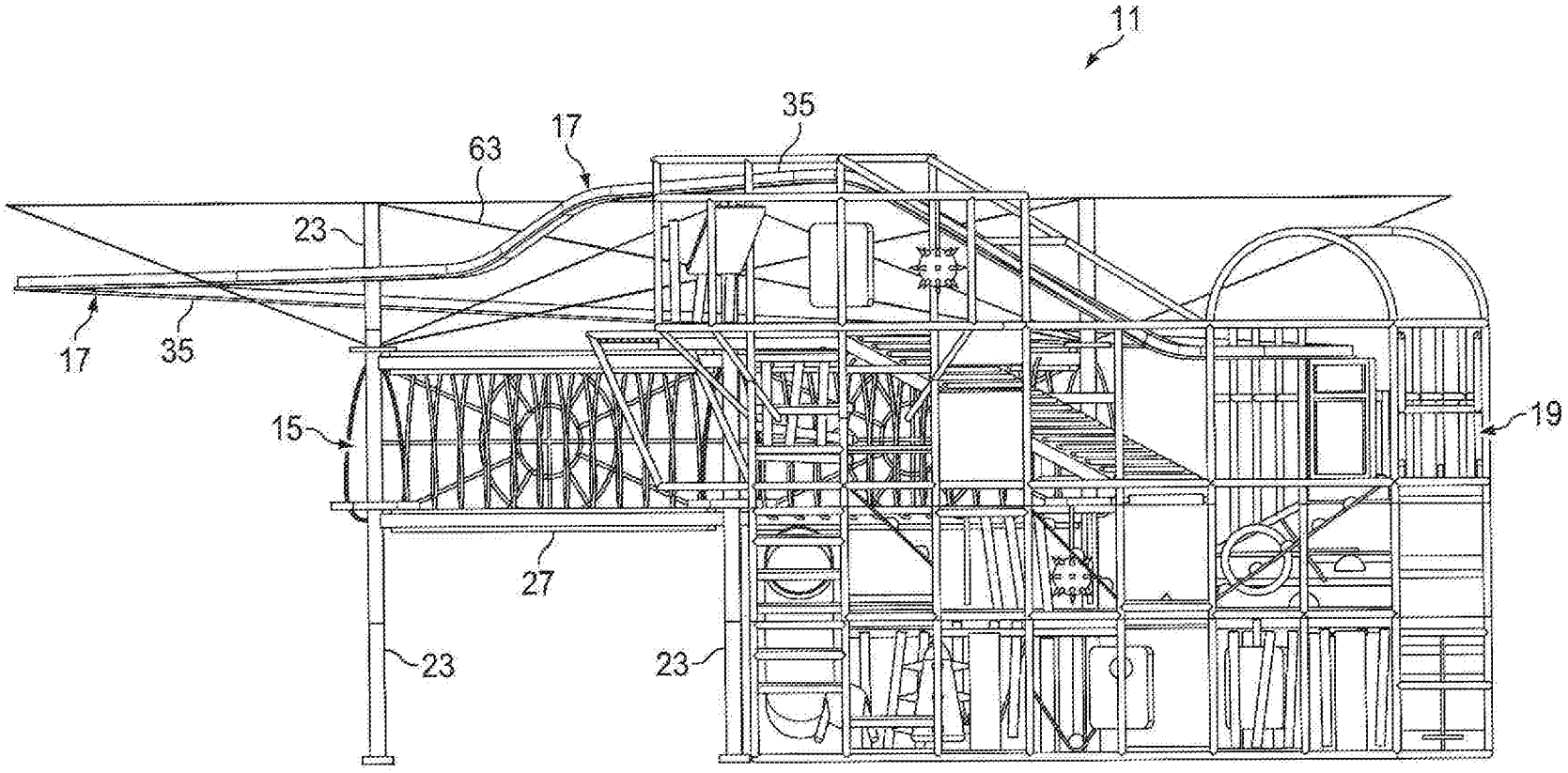
FIG. 3 is an elevational view of the equipment of FIG. 1, taken on the rear side.
Figure 4:
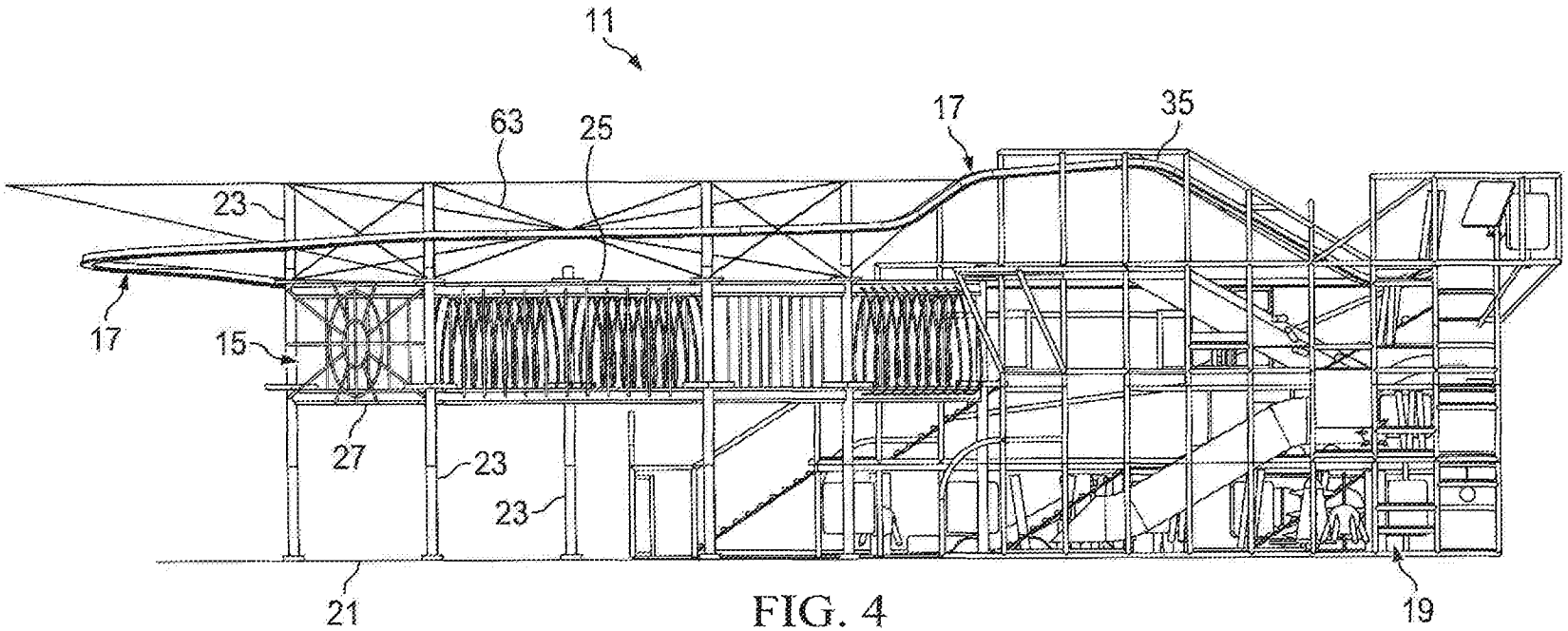
FIG. 4 is an elevational view of the equipment of FIG. 1, taken on the right side.

The specifies of the playground equipment 11 will now be described. In the description, references to the orientation of the equipment of FIG. 1 will be used. Such references include "front", which is taken from the bottom of FIG. 1 and shown in FIG. 5, "rear", which is taken from the top of FIG. 1 and shown in FIG. 3, "right" and "left" which are the right and left sides of FIG. 1 and shown in FIGS. 4 and 2 respectively.

The playground equipment includes several types of equipment. There is a first type 15, a second type 17 and a third type 19 (FIGS. 1-5). There may be additional types in other embodiments. The first and second types are elevated. In the preferred embodiment, the first type 15 is a ropes course and the second type 17 is a zip coaster. In the preferred embodiment, the third type of equipment is climbing equipment 19.

The user wears a safety harness to use the first and second types of equipment. Because the first and second types of equipment are elevated, if the user should foil to the ground, injury could result. The safety harness prevents a fall to the ground. The same safety harness can be used for each of the first and second types of equipment. This allows the user to change from one type of equipment to another without changing out of the safety harness. Such multiple uses add to the overall safety as the user is elevated above the ground in accessing the equipment. The user need not don and doff the safety harness when changing equipment.

The safety harness is conventional and commercially available. Examples of safety harnesses are shown and described in U.S. Pat. Nos. 5,203,829 and 7,631,728, the entire disclosures of which are incorporated by reference. Typically, a safety harness has loops for securing around the upper legs of a user, as well as straps along the chest and back of the user. The chest and back straps extend vertically and horizontally so as to secure the user in case the user should fall. The straps can be adjusted to accommodate different size users. A child will need the straps to be shorter than an adult. One or more vertical straps or lines extend up from the chest of back straps to connect to the safety or support apparatus above the user. The upper end of the vertical strap is a loop, typically of the carabiner type, that can be selectively opened to allow the strap and harness to be connected and unconnected to the support apparatus. The safety harness allows the user to walk freely and use their arms and hands.

The first type of equipment 15, or ropes course, is elevated above the floor or ground surface 21 (see FIGS. 1-5, 10-11). This adds to the enjoyment of the play, as users walk with their feet and traverse various paths at heights above the ground. The ropes course includes vertical supports 23, user safety supports 25 and user foot supports 27. The vertical supports 23 elevate the user foot supports 27 above ground, as well as the user safety supports 25 above the user foot supports. A user traverses by foot along the user foot supports 27. The user wears a safety harness which is secured to the to a user safety support 25 above the path.

The vertical supports 23 are typically posts or poles that extend from the floor 21 up to a distance. If the equipment is inside of a building, the vertical supports may extend to the ceiling of the building. Such a ceiling typically has trusses for supporting a roof. The poles 23 extend to and are connected to the ceiling trusses. If a pole is not aligned directly under a ceiling truss, a crossbar between trusses is used across the top of the pole. As an alternative, the top ends of the poles can be secured by cables extending to ceiling trusses, or other support structure. Thus, the poles are firmly anchored at the top and the bottom ends. The poles 23 are spaced apart horizontally from each other and are arranged in a spatial configuration. Some poles may be on an outside edge of the ropes course, while other poles may be on the inside. Each pole includes a platform 29 for users to stand on, as well as a hub 31 located above the platform.

The user safety supports 25 span horizontally between the hubs 31 of the poles. The user safety supports support the user in case the user should fall. The hubs 31 and the user safety supports 25 allow a harness supporting a user to traverse along from one pole 23 to another. The user safety support 25 can be a rigid beam that extends from one hub to another. The beam may be rectangular in transverse cross-section, with a bottom plate. The bottom plate has a longitudinal gap or slot therein. The bottom plate and slot form a track. The track receives a moveable member, such as a disc, with a short length of cable depending therefrom. Such an arrangement is shown and described in Liggett, U.S. Pat. No. 8,066,578 and Horihan, U.S. Patent Publication No. 20150217783, the entire disclosures of which are incorporated herein by reference. If desired, one or more rollers can be provided to reduce friction along the length of the beam. A loop is formed on the bottom end of the cable. The loop receives the carabiner of a safely harness.

When the user is connected by the safety harness to the support, the user is able to move generally in the direction of the longitudinal axis of the support, with the disc sliding inside of the beam. Due to some slack in the vertical strap of the safety harness extending up to the safety support, the user can move some distance in a transverse direction relative to the support.

As an alternative user safety support, a cable can be used, which cable extends between the adjacent poles. A pulley or trolley is used to connect to the safety harness and move along the cable. Such pulleys and trolleys are conventional and commercially available.

The user foot supports 27 span horizontally between the platforms 29 of the poles 23 and form paths or traverses. In general, the user foot support are designed to be difficult for a user to walk across from one platform to another. One example is a horizontal rope ladder, having rope rails that extend from one platform to another, and steps or rungs between the rails. The steps can be rope or wooden boards. The steps move somewhat as the user steps thereon, adding to the challenge of the traverse. Another example is a single length of rope extending between two platforms; the user walks along the foot rope. To provide the user with a hand hold, a rope net extends along the foot rope. Alternatively, two upper ropes extend parallel to the foot rope, forming a "V" configuration when viewed from the end. The foot rope is at the bottom of the "V", while the hand rails are above and laterally offset. Still another example is a narrow beam for the user to walk along. The beam is rigid and does not move, but the narrowness increases the challenge of walking across. Still another example is a series of shaped steps mounted to a beam. The steps are fixed, but present relatively small surface area on which to stand. The steps may be circular to simulate stepping on rocks. Still another example is a series of swings; the user steps from one swing to another, holding onto the swing ropes for stability. The swings of course move as the user steps thereon.

Horizontal beams may be provided under the user foot supports to further provide rigidity and stability to the poles. This is particularly the case if the user foot supports do not incorporate rigid beams. Generally, the user foot supports and any horizontal beams are well above the ground to allow adult humans to walk underneath.

Each pole 23 serves as the junction of two or more user foot supports 27 and the respective user safety supports 25. The user foot supports 27 lead to the platforms 29. The hubs 31 connect the user safety supports 25. A user arriving on a platform 29 from one user foot support exits the platform on another user support. The safety harness is able to move from one user safety support 25 across the hub 31 to the other respective user safety support. Preferably, the user need not disconnect and reconnect the safety harness to the user safety support when changing traverses. In this manner, the user moves around the ropes course.

Figure 1:
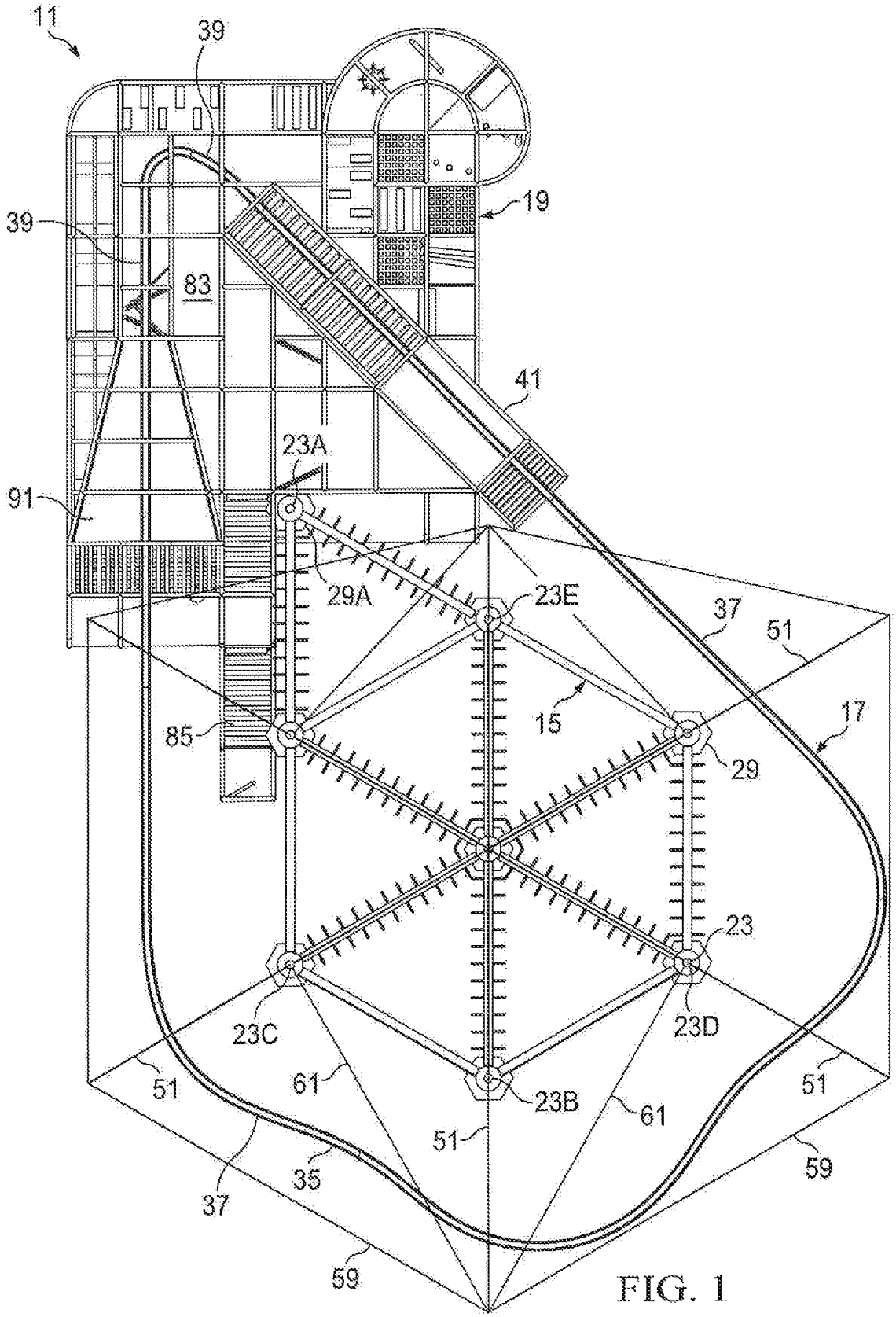
FIG. 1 is a plan view of multi-level play equipment, in accordance with a preferred embodiment.
Figure 8:
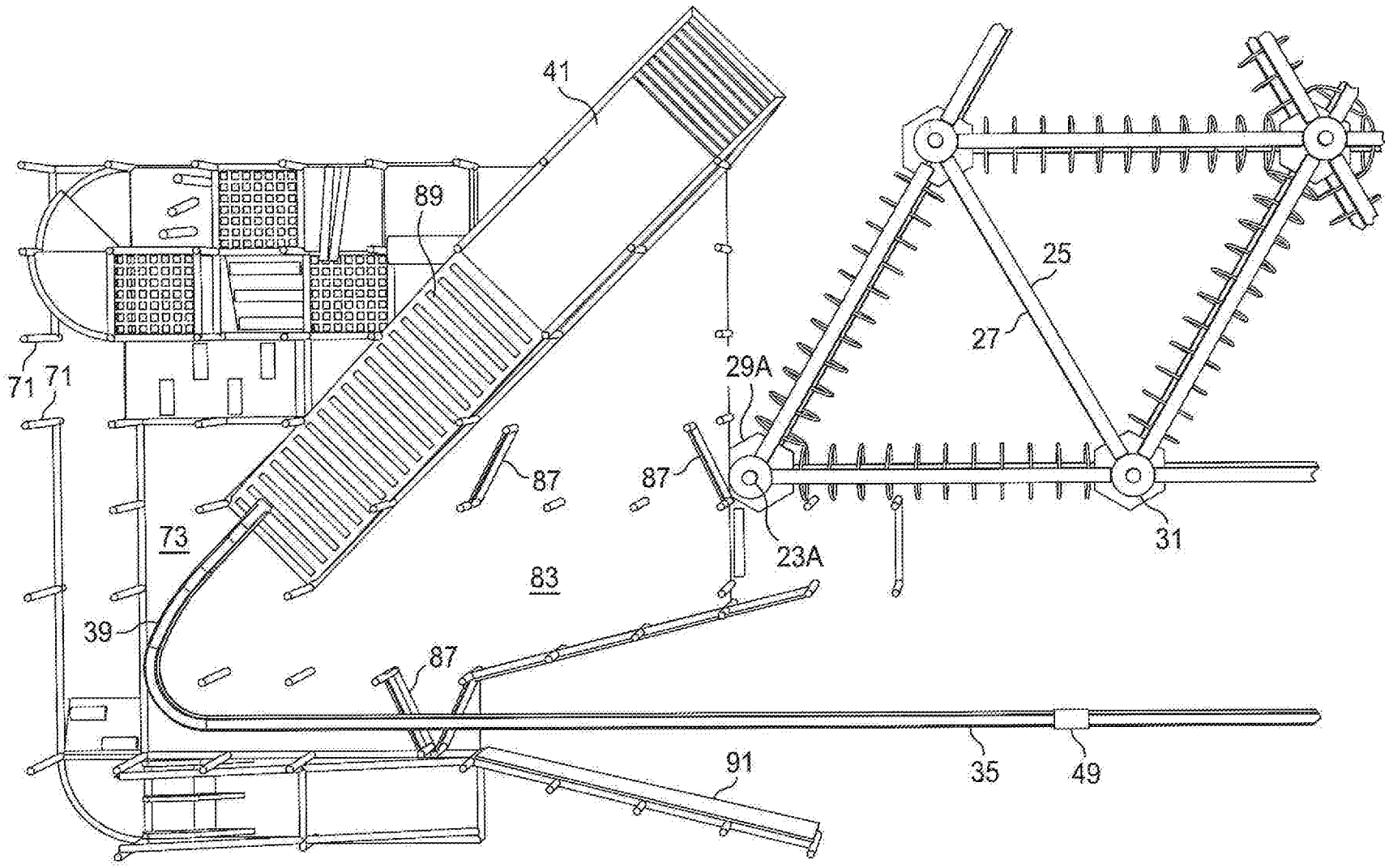
FIG. 8 is a top view of the third level of the play equipment, showing portions of the first and second types of equipment.

In the preferred embodiment, there is a start/finish platform 29A and associated pole 23A (see FIGS. 1 and 8). A user starts or enters the ropes course from this platform 29A, traverse various foot supports and ends on the same platform 29A to exit the ropes course. In other embodiments, there may be a start platform on one pole and a separate finish platform on another pole.

The other platforms 29 and poles 23 are spaced apart from the start/finish platform 29A and from each other. A typical arrangement is shown in FIG. 1, where the poles are arranged in a triangular configuration, with each pole being an apex of a triangle. In the arrangement shown, the overall shape is somewhat of a hexagon, which hexagon has six triangular areas and a central pole. Another triangular area extends to a side of the hexagon, which area connects to the start/finish pole. Other configurations can be used besides triangular or hexagonal.

Before discussing further the area around the start/finish pole, the zip coaster 17 will be discussed first (see FIGS. 1-5, 10-11). The zip coaster has a rail 35 that is elevated above the ground 21 and that runs in a continuous loop. The rail 35 has a riding section 37 and a recovery section 39. The rail changes elevations. At a starting area, or platform 41, the rail is at its highest elevation. At a recovery area 43, the rail is at its lowest elevation. The users ride along the riding section, which section has a gentle downward slope. The users are suspended beneath the rail 35 in a safely harness and with their feet hanging tree, pulled by gravity along the rail. The riding section extends from the starting area 41 to the recovery area 43 and the rail slopes down. For example, the slope may be 20:1, or a foot drop for each 20 feet of horizontal run. In the recovery area, the users are connected to and disconnected from the rail, while still wearing the safety harness. In the recovery section, the rail extends from the recovery area back to the starling area and rises back to the highest elevation. The recovery section is typically much shorted and steeper than the riding section.

Figure 10:
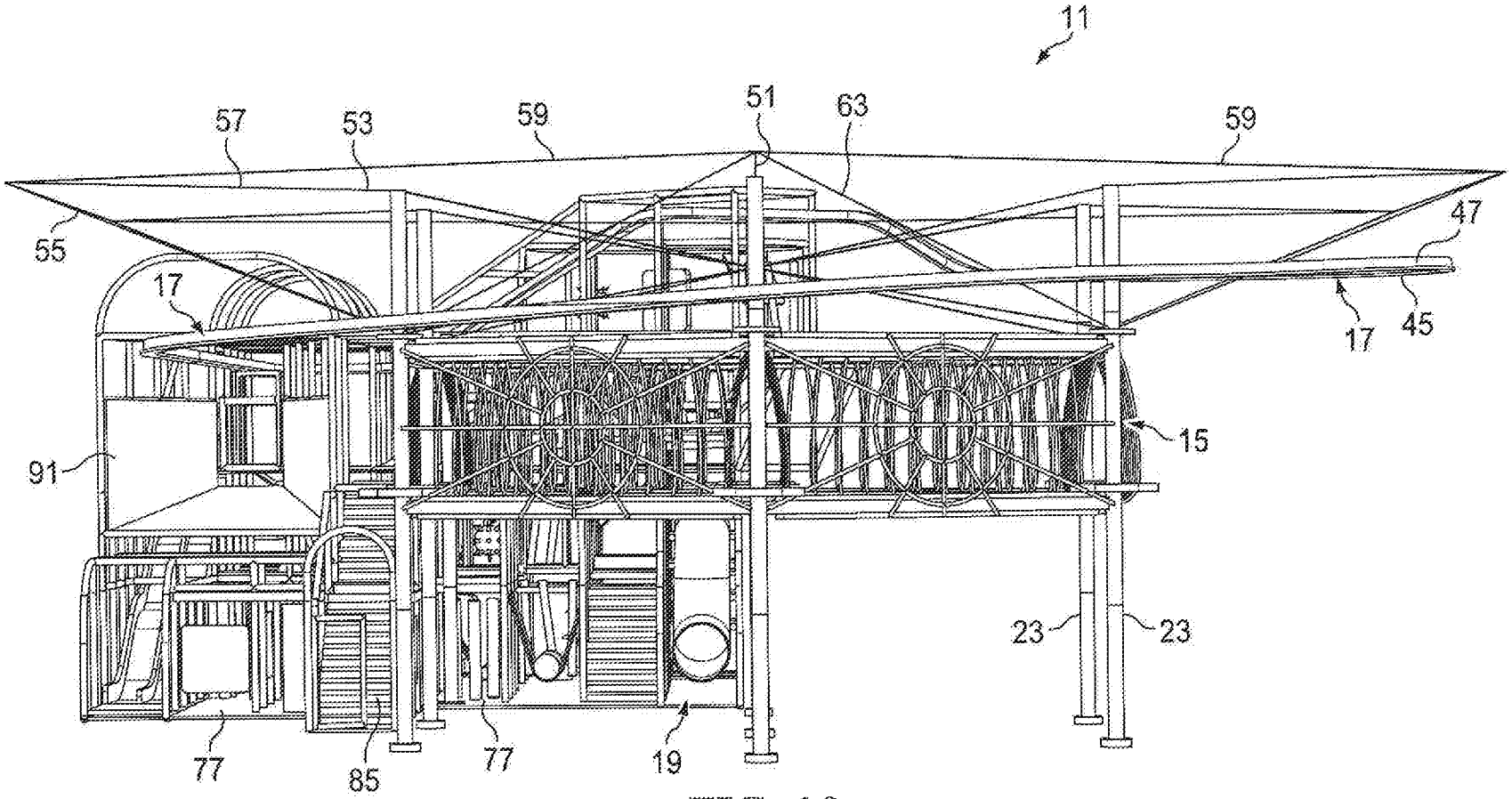
FIG. 10 is a perspective view of the equipment from the front side.
Figure 11:
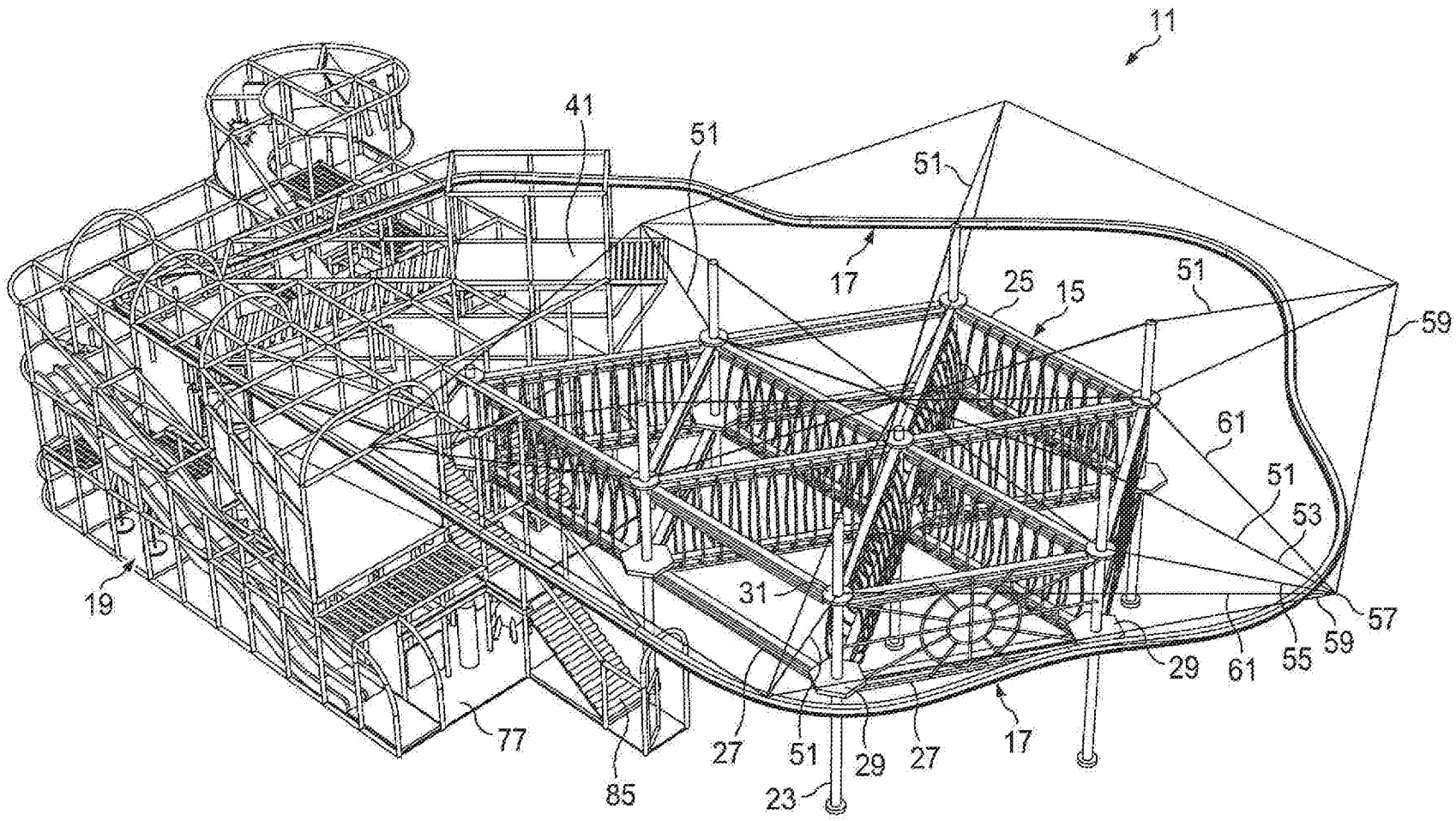
FIG. 11 is a perspective view of the equipment from the upper front and right sides.

The rail 35 is a cylindrical tube 45 with a flange 47 that extends vertically up (see FIG. 10). The flange 47 extends longitudinally along the tube 45. A trolley 49 (see FIG. 8) is slung under the rail and rides along the upper surfaces of the rail. The trolley also has rollers that engage the sides of the flange. A yoke depends from the trolley. The yoke has a loop for receiving a carabiner of a safety harness. A user connects a safety harness to the yoke. The yoke also has lengths of rope that depend down. The user grips the ends of the ropes with the hands to provide some stability during the ride. Zip coaster rails and trolleys are conventional and commercially available.

The flange 47 is used to support the rail above the ground. The rail can be supported above ground by several arrangements. One arrangement is by trusses 51 (see FIG. 11) which are separate from the ceiling trusses, which trusses are supported by the ropes course posts 23 and the building. In the embodiment shown, the riding section 37 of the rail is supported by the trusses 51. Each truss 51 is generally triangular shaped, having a top beam 53 and a bottom beam 55. The top beam 53 is connected to a ropes course post 23 and extends across the rail 35 some distance. The bottom beam 55 extends from a lower location on the same ropes course post 23 to the end of the top beam to form an apex, or free end 57, of the triangular truss. In the embodiment shown, where the rail 35 encircles the ropes course 17, each of the outer poles has a truss 51 extending out over the rail. To maintain lateral stability the trusses 51 are connected together at their free ends. Cables 59 extend from each free end 57 to adjacent truss free ends. Cables 61 also extend from each free end 57 to a lower portion of adjacent poles 23. The trusses are located above the rail (not all cables 61 are shown). Cables (not shown) extend from the trusses 51 to anchor points along the rail flange 47. At each anchor point, several cables extend to adjacent trusses and ropes course poles 23. The ropes course poles are laterally offset from the rail. More than one cable is used for each anchor point to minimize swaying or other movement of the rail.

Figure 2:
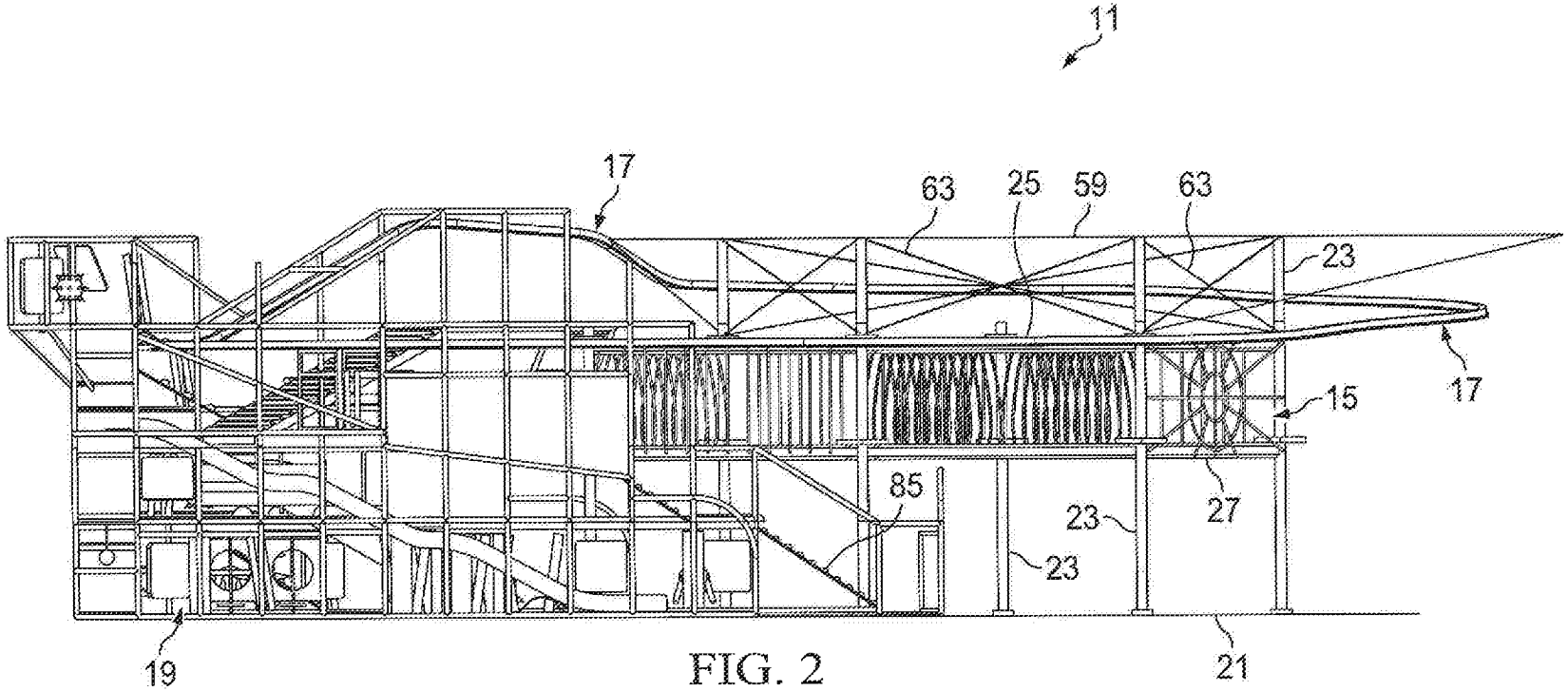
FIG. 2 is an elevational view of the equipment of FIG. 1, taken on the left side.
Figure 5:
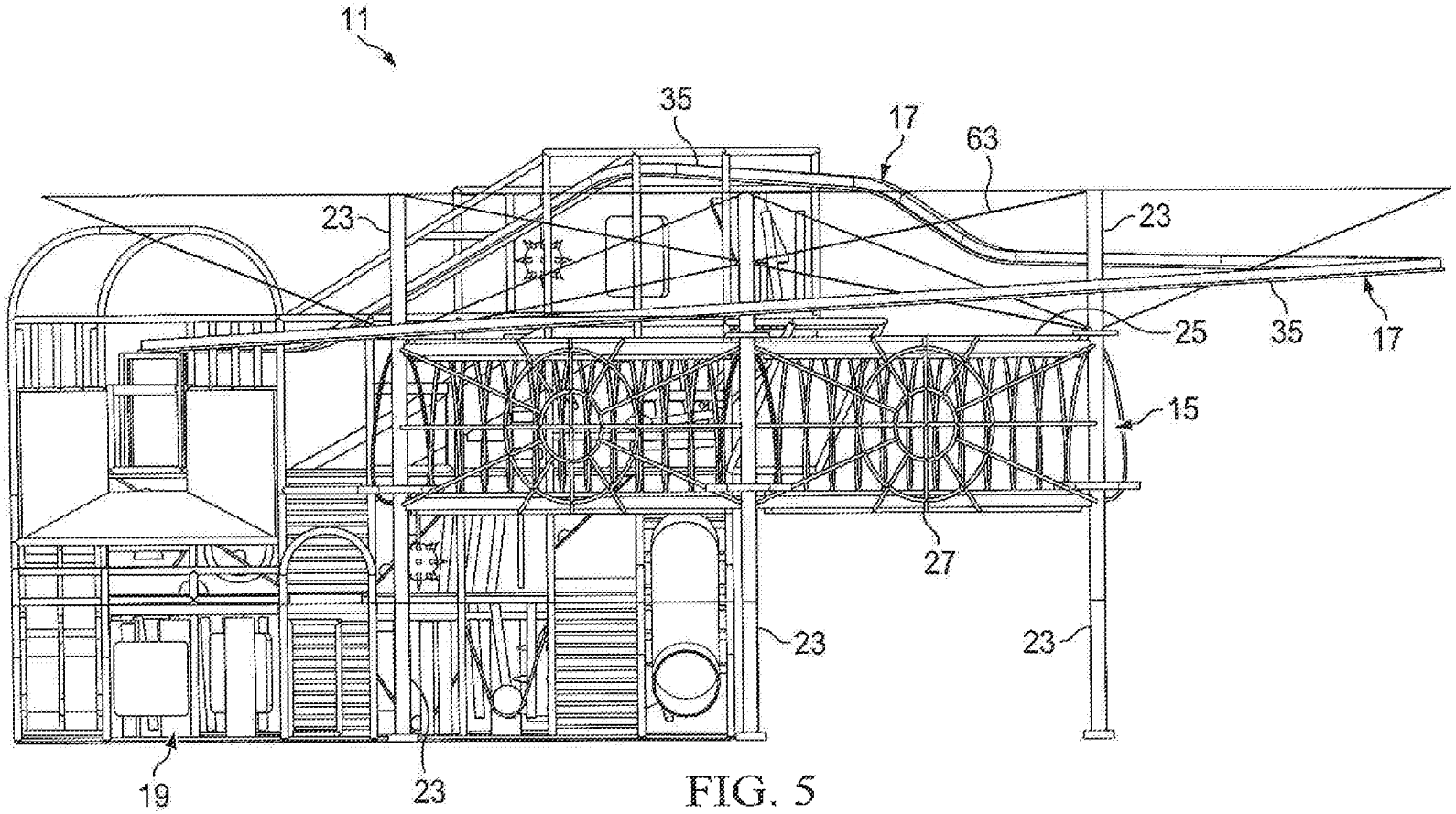
FIG. 5 is an elevational view of the equipment of FIG. 1, taken on the front side.

The upper portions of the ropes course poles 23 are reinforced by cables 63 leading to other poles (see FIGS. 2 and 5). For example, with the hexagonal arrangement shown in FIG. 1, cables extend from pole 23B to poles 23C, 23D and 23E. These cables are located above the ropes course user safety support 25 so as not to interfere with the user safety equipment. One cable 63 extends from the top of pole 23B to a lower portion of pole 23C, while a second cable 63 extends from the top of pole 23C to a lower portion of pole 23B, thus forming a cross-work of cables. Similar cross-works are formed between poles 23B and 23D and between poles 23B and 23E. Likewise, other cable cross-works are formed between other adjacent poles. The trusses 51 preferably are in line with the reinforcing cables 63. The center pole 23D may be shorter and not extend above the user safety support, in order to stay clear of the reinforcing cables.

Another arrangement is to support the rail from the ceiling trusses, or other ceiling support structure, of the building. Cables extend from the trusses to various anchor points along the flange. Still another arrangement is to use separate poles to support the rail by way of cables. These separate poles are not used to support the ropes course. Still another arrangement is to use a rigid support on poles. The poles are located near to the rail at the anchor points. Yet, the poles are spaced far enough away to avoid contact with users riding the rail. A lateral beam extends from the pole to over the rail and a vertical support extends from the beam down to the rail. The recovery section 39 of the rail uses pole supports.

The rail 35, forming a continuous loop, can have a variety of plan view shapes. In general, the rail has curves to enhance the riding pleasure. As a user rides the rail along a curve, the user's body swings to the outside of the curve. Therefore, the rail is positioned relative to other objects so as to provide sufficient clearance for the user. If the user moves clockwise (when in plan view) along the rail, due to the closed loop nature of the rail the curves will be primarily to the right (right hand curves from the user's perspective). However, the rail can also curve in the opposite direction, to the left (left hand curves). The rail shown in FIG. 1 has several right hand curves, two of which are about ninety degrees. The rail also has several left hand curves, located between the right hand curves. The left hand curves are smaller, or less of a curve, than the right hand curves.

The zip coaster 17 and the ropes course 15 may be nested one inside of the other. FIG. 1 shows the zip coaster rail extending around the periphery of the ropes course. The ropes course 15 lies completely within the loop of the zip coaster rail 35. This makes efficient use of floor or ground space of the facility. The zip coaster rail can be over open floor space, or it can be over occupied floor space. Such occupied floor space can be taken up by other equipment such as tables, chairs, even rooms with partition walls. The partition walls extend up, stopping short some distance from the ceiling so as not to interfere with a user of the zip coaster. Other equipment that requires some height above the floor, such as trampolines or those involving ball throwing, are typically not located under the zip coaster, unless the height of the zip coaster allows sufficient vertical clearance. The same is true of the ropes course or other elevated equipment. Although the embodiment shown nests the ropes course inside the zip coaster, this need not be the case. The ropes course can be outside of the zip coaster, or some other configuration could be used.

The ropes course 15 and the zip coaster 17, being elevated, have access and exit locations that are elevated. These access and exit locations are combined with the third type of equipment, which is located under and at the same level of the access and exit locations to the rope course and the zip coaster. In the preferred embodiment, the third piece of equipment is a multi-level obstacle course 19.

Figure 6:
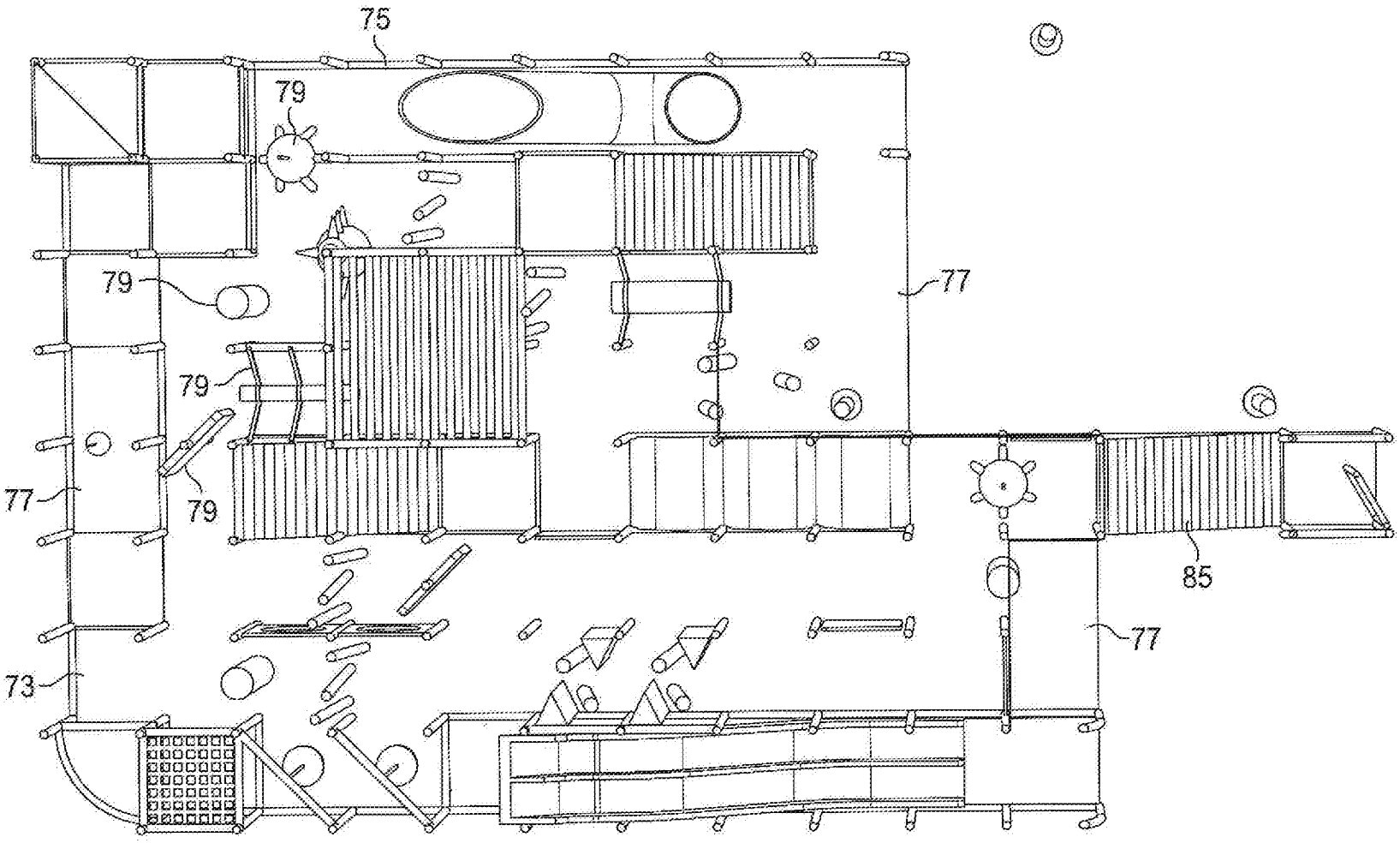
FIG. 6 is a top view of the first level of the third type of equipment.
Figure 7:
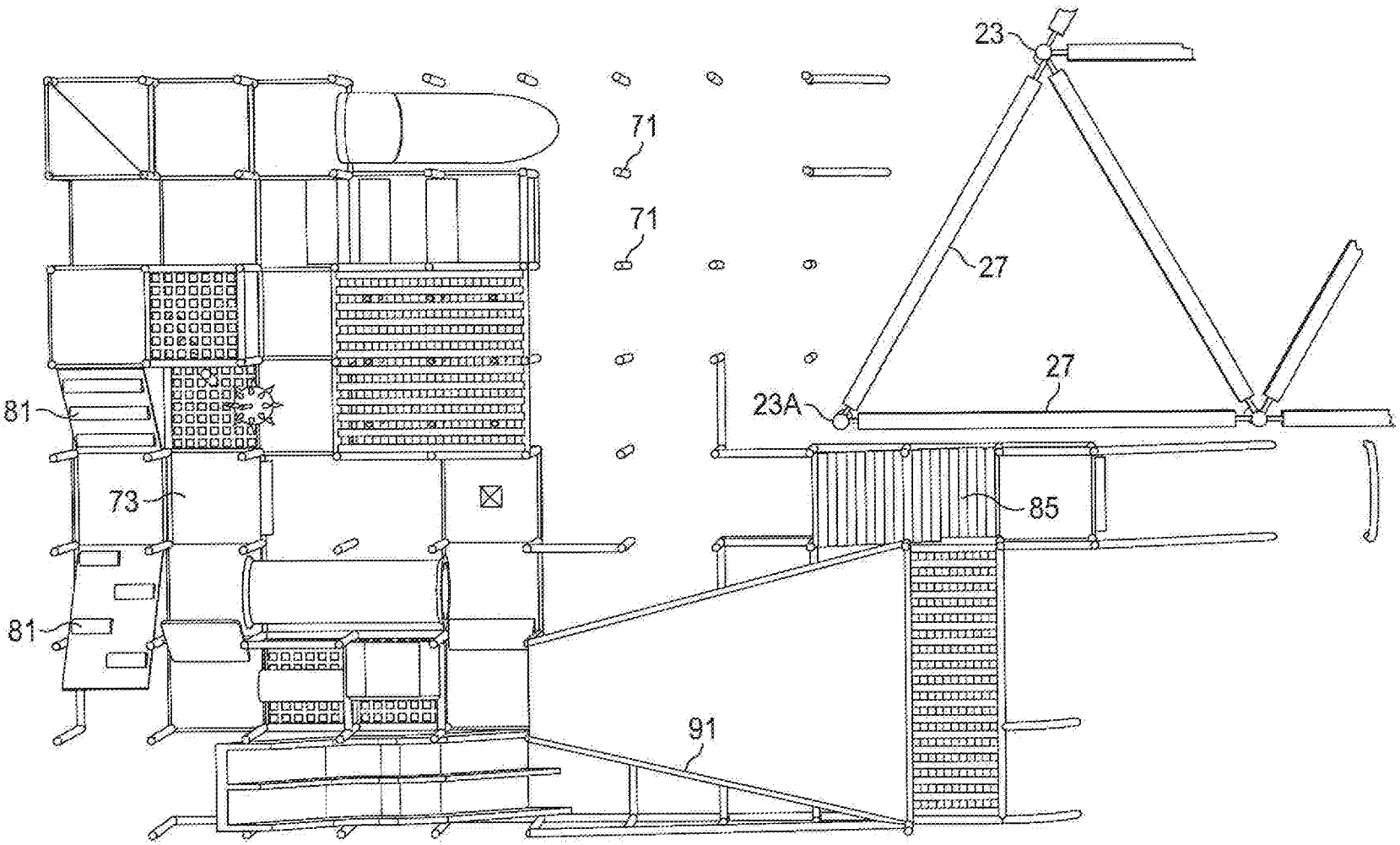
FIG. 7 is a top view of the second level of the third type of equipment, showing portions of the first and second types of equipment.
Figure 9:
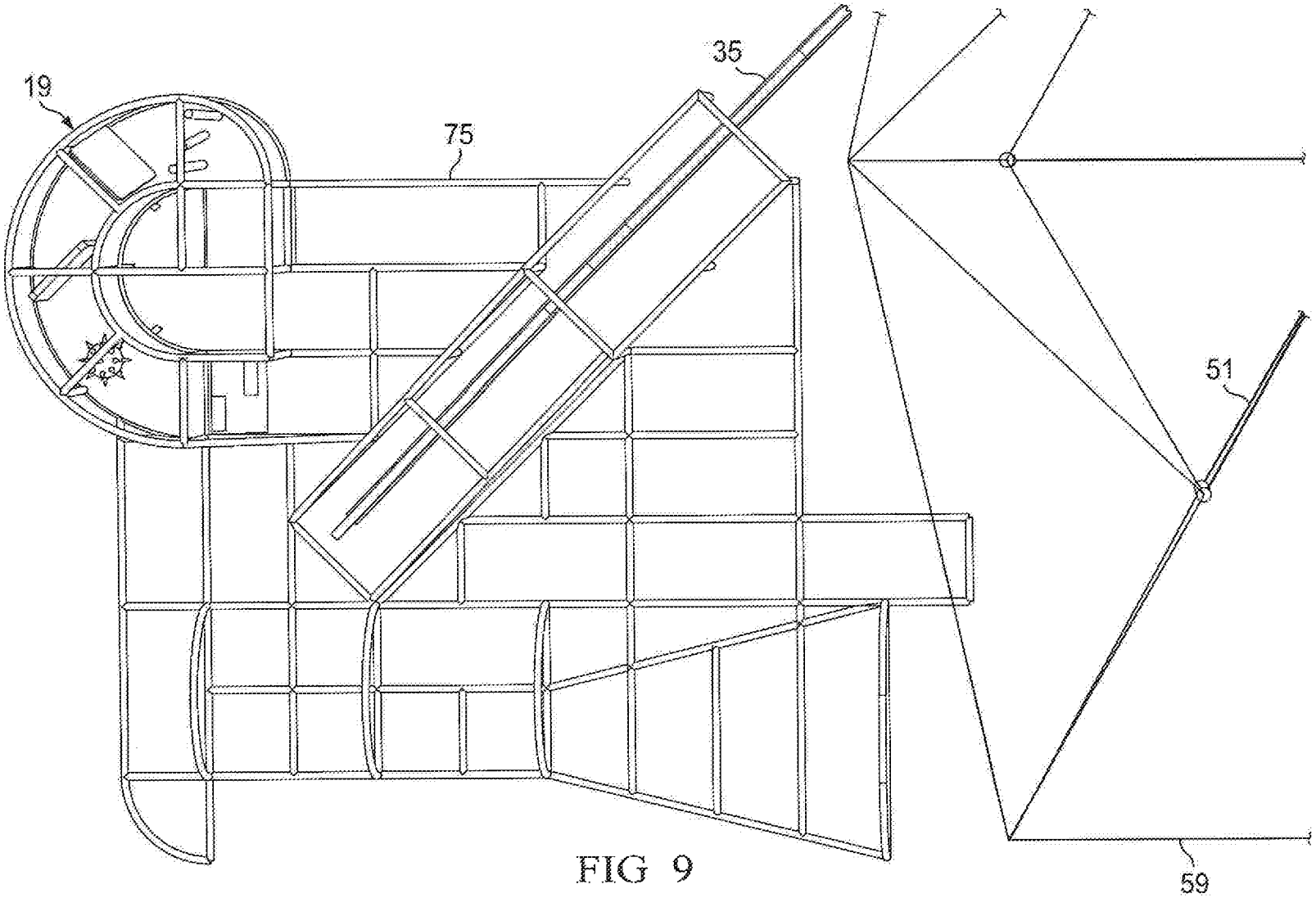
FIG. 9 is a top view of the fourth level of the play equipment, showing portions of the first and second types of equipment.

The obstacle course has, in the embodiment shown, four levels, namely in ascending order: the ground, or first, level (see FIG. 6), the second level (see FIG. 7), the third level (see FIG. 8), and the fourth level (see FIG. 9). Each level has vertical poles 71 or posts, floors 73, and cross members 75 that extend between the posts. The height of the levels need not be the same. Some levels may be designed for children and thus have a lower height that levels designed to accommodate adults. The outer sides of the levels are spanned by netting or some other barrier material to prevent people from passing therethrough. This is particularly desirable on the upper levels. In addition, barrier material is provided at other locations where desired. The ground level has entry and exit locations 77. These entry and exit locations are typically located on one side. As users enter the ground level, they traverse by walking or running or even crawling and pass through or by various objects of interest 79, such as tubes, swinging cylinders, gates, net flooring, bars, swinging balls, etc. Padding is provided where needed. Users can move to the next level by ascending stairs or ladders, or crawling through holes. Users can descend to a lower level or exit the equipment by slides.

The second level (see FIG. 7) is reachable by stairs 81 from the first level and offers more of the same type of obstacles as found on the first level.

The third level (see FIG. 8) is a common area 83 for the ropes course and the zip coaster. The third level is reachable directly from the ground by stairs 85. Thus, adults or children who wish to bypass the obstacle levels can ascend to the third level. As another way to access the third level, stairs 81 lead from the second level to the third level. These stairs are on the opposite side from the ground level stairs.

From this common area 83, users can enter the ropes course and the zip coaster. The users put on safety harnesses. Attendants are provided to ensure that the harnesses are correctly worn. The harnesses can be put on while a user is in the common area. Alternatively, the harnesses can be put on while the user is on the floor, before ascending to the third level.

The common area, or third level, may have partitions and gates 87 through the partitions to control access to the elevated equipment. This level also may have obstacle type equipment, as a continuation or extension of the obstacle equipment on the other levels. Access and exit locations are provided. The obstacle area may be partitioned from the areas serving the elevated equipment.

Once harnessed, a user is secured to the ride of choice. For the ropes course 15, the user's harness is coupled to the cable depending from the disc in the user safety support 25. A gate 81 on the third level controls access to the ropes course. Typically, the gate is closed, cutting off access to the ropes course, until the user is safely secured. The user then passes through the gate and steps on the platform 29A of the start/finish pole. Typically, this platform is at the same level as the common area floor, but it may be higher or lower. The user then walks along one of the traverses leading from the platform, to reach the next platform 29, and so on along the various traverses. As the user walks, the safety harness pulls the disc along the track of the user safety support 25. To finish and exit the ropes course, the user returns to the platform of the start/finish pole and passes through the gate, to stand on the common area once again. There, the user is disconnected from the user safety support. The user continues to wear the safety harness.

The user may proceed to the zip coaster 17. A gate 87 may be used to control access to the zip coaster. Passing through the gate the user moves to the loading area for the zip coaster. The loading area is in the common area and on the third level. The loading area is a floor area under the recovery section 39 of the rail. The user is assigned to a trolley. For safety reasons, the trolleys remain on the rail and are not removed therefrom. The user is secured by way of the safety harness to the trolley. Once secured, the user ascends stairs, or a ramp, 89 to the starting platform 41. The safety harness pulls the trolley along the upwardly inclined rail. The platform is located above the third level at a higher elevation.

Once on the platform 41, the user can step or leap off and ride the zip coaster. Stepping or leaping off the platform suspends the user by the safety harness beneath the trolley. The user is provided with ropes to hold on to by the hands. The user's feet are free. Gravity pulls the trolley along the riding section 37 of the rail 35. As shown on the left sides of FIGS. 3 and 4 and the right side of FIG. 5, the rail is over ground, which ground may be occupied by other objects (tables, queues for lines, etc.). As the user rides, the user passes over these areas and objects. If the ropes course is nearby, the user passes along an edge of the ropes course.

Near the end of the ride, the user enters a funnel shaped recovery area 91 (see FIGS. 1 and 8), having padded bottom and side walls. The recovery area narrows in cross-sectional area over a distance. This assists in stabilizing a rider who may be swinging to one side or the other. The bottom of the recovery area slopes up to the third level, which allows the user to place their feet again on the floor of the third level. Once the user is standing and has passed through a gate 87, the safely harness is disconnected from the trolley. The user can exit the zip coaster loading area through a gate. The trolley is reused by the next user.

The exit the third level a user can descend the stairs 85 to the ground, or the stairs to the second level, or ride a slide to the ground.

The obstacle portion of the third level has access to a fourth level by way of stairs. The fourth level contains additional obstacles. In the embodiment shown the fourth level is located on a corner to provide visibility. The zip coaster platform may be at the same elevation as the fourth level, or at a different elevation.

Figure 12:
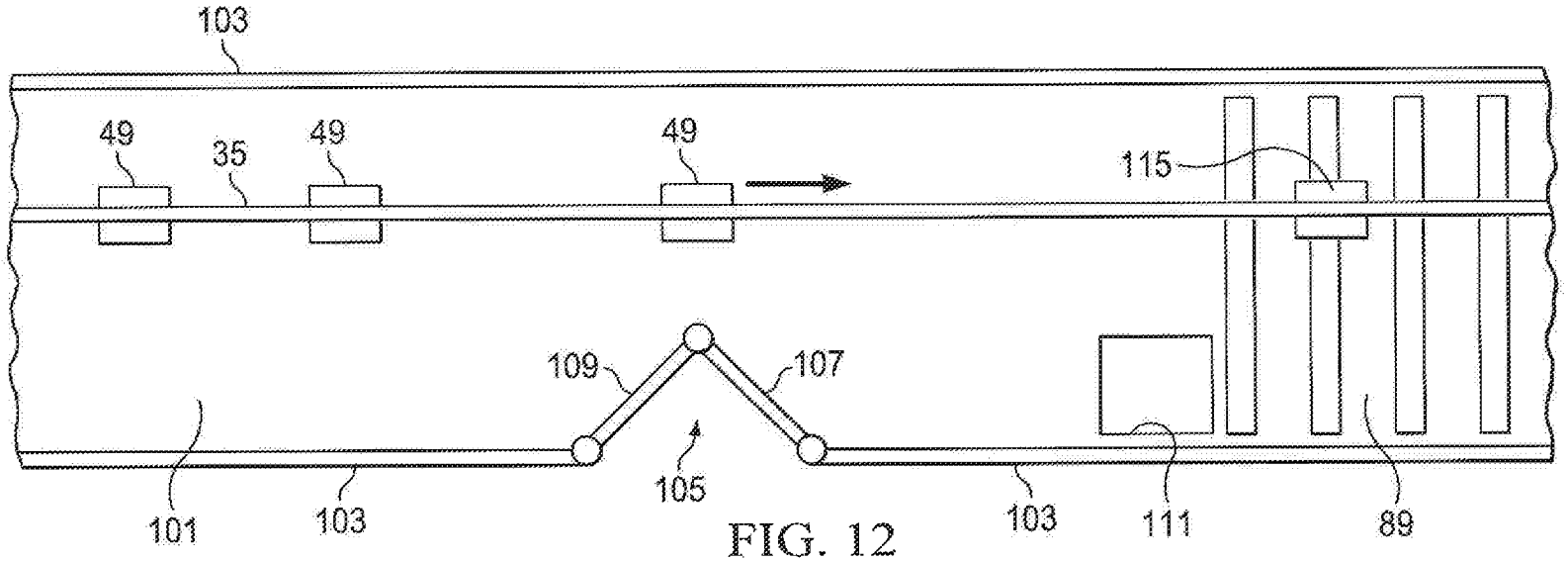
FIG. 12 is a plan view of a loading area and surroundings for the zip coaster, in accordance with one embodiment.

FIG. 12 shows an entry and exit area for the zip coaster, in accordance with another embodiment. In this embodiment, a user enters and exits in the same location. The zip coaster rail 35 is shown, with several trolleys 49 at the ready. A padded floor 101 is located underneath the rail. The direction of trolley travel in the figure is left to right. A barrier 103 closes off the zip coaster area from the common area to control users for their safety. The barrier 103 has a gap therein, with a loading area 105 being provided through the gap. The loading area is isolated from the zip coaster area by an entry gate 107 and an exit gate 109. The gates form a triangular shaped loading area 105.

A user typically dons a safety harness before entering the loading area, although the user can don the harness in the loading area. When a user stands in the loading area, an attendant, who stands outside of the loading area, checks the safety harness for proper fit and couples the safety harness to a trolley 49. Once satisfied with the proper connections and fit, the attendant opens or unlatches the entry gate 107 to allow the user to enter the zip coaster area, closing the gate 107 after. Another check can be performed, namely a slack test. The user descends into a depression 111 or well in the floor surface 101. This tests the slack in the safety harness. The attendant can adjust the tightness of the harness to allow the user to be suspended at the desired distance below the trolley. The user steps back onto the floor 101.

A control device 115 is provided on the zip coaster rail. The device 115 prevents users from moving along the zip coaster rail in an unapproved manner. Should a user try to move along the rail before the attendant is satisfied with the safety arrangements, the trolley contacts the control device 115 and is stopped from moving any further forward. The user is thus prevented from traversing along the zip coaster in an unauthorized manner. In the embodiment shown in FIG. 12, the control device 115 is located at the base or bottom portion of the ramp 82.

Figure 13:
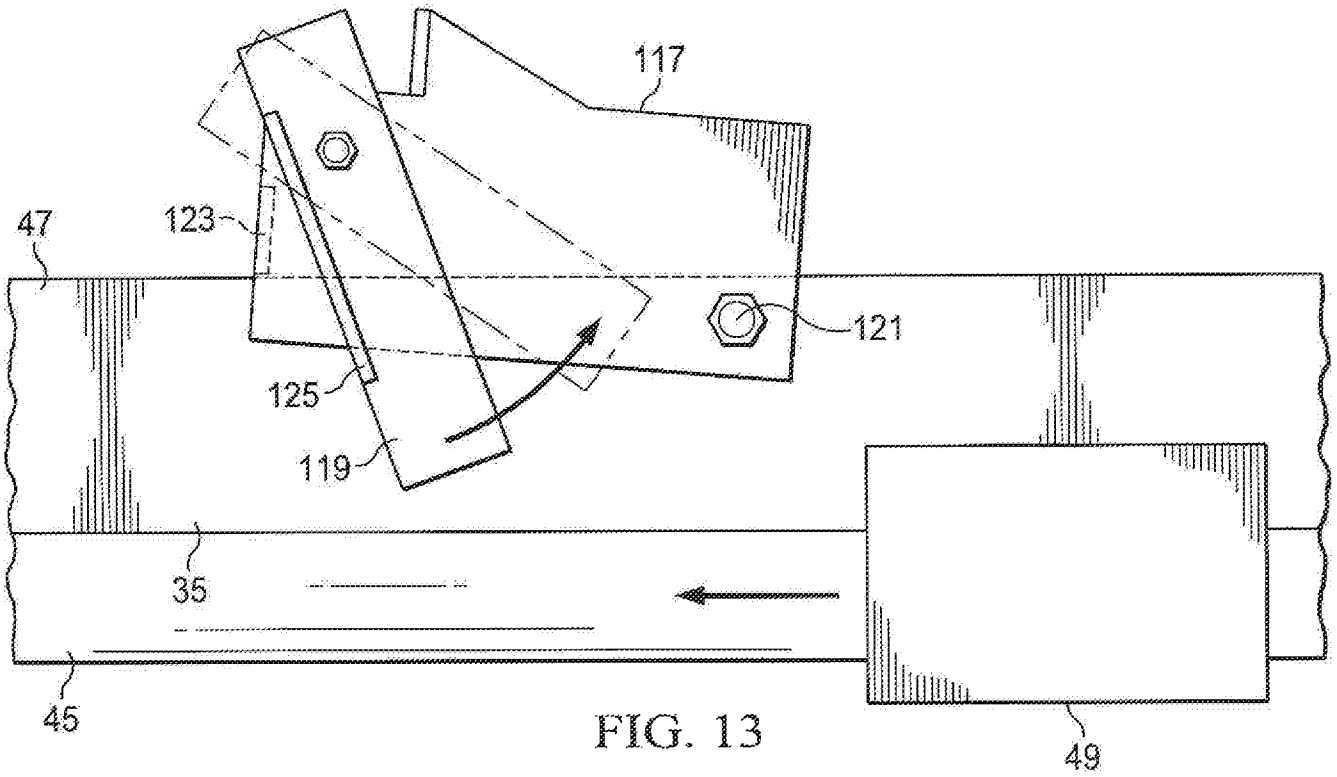
FIG. 13 is a side view of a one-way control device on the zip coaster rail.

Referring to FIG. 13, the control device has a mounting member 117 and a pivoting member 119. The mounting member 117 has parallel plates separated by a gap, which gap receives the upper edge of the flange 47 of the rail 35. A fastener 121 secures the mounting member to the flange 47. A spacer plate 123 in the gap contacts the upper edge of the flange. The pivoting member 119 is shaped like an upside down "U" and is pivotally mounted to the mounting member 117. The pivoting member 119 moves between a blocking position (shown in solid lines in FIG. 13) and an open position (shown in dashed lines). The pivoting member is normally in the blocking position. In the blocking position, the pivoting member blocks the trolley 49 from moving in the forward direction (right to left in FIG. 13). Raising the pivoting member to the open position allows the trolley to move past the control device.

The device 115 is a one-way device. If the trolley is located down the rail and moves in the reverse direction (left to right in FIG. 13), the pivoting member moves to the open position, without the need for an attendant. This allows a user to reach the top of the ramp 89 and change their mind, to retreat back to the loading area without traversing the zip coaster.

When the attendant is satisfied with the readiness of the user, the attendant reaches up with a hand to move the pivoting member 119 to the open position, so that the trolley can pass underneath. The pivoting member can be provided with flanges 125 to allow for better contact or a grip.

The user moves under the control device, climbs the ramp 89 and traverses the zip coaster, returning along the floor 101 (left side of FIG. 12). The attendant opens the gate 109 and the user moves into the loading area 105. After closing the gate 19, the attendant disconnects the harness from the trolley.

The process repeats with the next user.

Thus, the equipment provides a safe and enjoyable venue for users in a compact space.

The foregoing disclosure and showings made in the drawings are merely illustrative of the principles of this invention and are not to be interpreted in a limiting sense.

The invention claimed is:

1. A play apparatus, comprising:

a) a first type of elevated equipment, the first elevated equipment having a first user safety support that extends for a first traverse, the first user safety support elevated above the ground level, the first user safety support configured to receive a safety harness worn by a user and allowing the safety harness to move with the user along the first traverse, the first elevated equipment having a first entry location for the user to enter the first elevated equipment and a first exit location for the user to exit the first elevated equipment;

b) a second type of elevated equipment, the second elevated equipment having a second user safety support that extends for a second traverse distance and that forms a closed loop, the second user safety support elevated above the ground level, the second user safety support configured to receive the safety harness worn by the user, the second user safety support allowing the safety harness to move with the user along the second traverse, the second elevated equipment having a second entry location for the user to enter the second elevated equipment and a second exit location for the user to exit the second elevated equipment;

c) a common hub area comprising a platform that is elevated above the ground at a platform elevation, the common hub area including the first entry location, the first exit location, the second entry location and the second exit location, the first type of elevated equipment extending for the first traverse from the first entry location away from the common hub area and returning to the common hub area at the first exit location, the second type of elevated equipment extending for the second traverse from the second entry location away from the common hub area and returning to the common hub area at the second exit location, at least one of the second entry location or the second exit location at the platform elevation, the other of the second entry location or the second exit location located at a different elevation than the platform elevation.

2. The play apparatus of claim 1 wherein the first type of elevated equipment is different than the second type of elevated equipment.

3. The play apparatus of claim 2 wherein the first type of elevated equipment comprises a ropes course.

4. The play apparatus of claim 2 wherein the second type of elevated equipment comprises a zip coaster, the zip coaster comprising a rail that extends from the common area in a closed loop, the zip coaster also comprising at least one trolley that moves along the rail and allows a user to be suspended below the trolley.

5. The play apparatus of claim 1 wherein the first entry location and the first exit location are one location.

6. The play apparatus of claim 1 further comprising a loading area, the loading area comprising an entry gate that allows entry to the second entry location and an exit gate that allows exiting from the second exit location.

7. The play apparatus of claim 1 further comprising a third type of equipment located under the common hub area.

8. The play apparatus of claim 7 wherein the third type of equipment comprises an obstacle course.

9. The play apparatus of claim 7 wherein the third type of equipment has portions located above the common hub area.

10. The play apparatus of claim 1 wherein:

a) the first type of elevated equipment comprises a ropes course;

b) the second type of equipment comprises a zip coaster;

c) a loading area, the loading area comprising an entry gate that allows entry to the second entry location and an exit gate that allows exiting from the second exit location;

d) a third type of equipment located under the common hub area.

11. The play apparatus of claim 1 wherein the common hub area is elevated above the ground at a single platform elevation.

12. A play apparatus, comprising:

a) a first type of elevated equipment, the first elevated equipment having a first user safety support that extends for a first traverse, the first user safety support elevated above the ground level, the first user safety support configured to receive a safety harness worn by a user and allowing the safety harness to move with the user along the first traverse, the first elevated equipment having a first entry location for the user to enter the first elevated equipment and a first exit location for the user to exit the first elevated equipment;

b) a second type of elevated equipment, the second elevated equipment having a second user safety support that extends for a second traverse distance, the second user safety support elevated above the ground level, the second user safety support configured to receive the safety harness worn by the user, the second user safety support allowing the safety harness to move with the user along the second traverse, the second elevated equipment having a second entry location for the user to enter the second elevated equipment and a second exit location for the user to exit the second elevated equipment;

c) a common area elevated above the ground, the common area including the first entry location, the first exit location, the second entry location and the second exit location;

d) wherein the first type of elevated equipment is different than the second type of elevated equipment;

e) wherein the second type of elevated equipment comprises a zip coaster;

f) the zip coaster further comprises a rail;

g) further comprising a control device located on the rail and moveable between blocking and open positions, wherein when the control device is in the blocking position, forward movement of a trolley on the rail past the control device is stopped and when the control device is in the open position, forward movement of the trolley past the control device is allowed.

* * * * *